US005540269A

United States Patent [19]

Plumer

[11] Patent Number: 5,540,269

[45] Date of Patent: Jul. 30, 1996

[54] MOTOR-DRIVEN ROLLER BLIND

[75] Inventor: Louis Plumer, Dole, France

[73] Assignee: Plumer (Societe Anonyme), Saint-Louis, France

[21] Appl. No.: 221,794

[22] Filed: Apr. 1, 1994

[30] Foreign Application Priority Data

Apr. 5, 1993 [FR] France ..... 93 04155

[51] Int. Cl.[6] ..... E05F 15/20

[52] U.S. Cl. ..... 160/3; 160/133; 160/188; 160/310; 49/28; 318/467

[58] Field of Search ..... 160/1, 2, 3, 188, 160/310, 133; 49/26, 28; 318/467

[56] References Cited

U.S. PATENT DOCUMENTS

| | | | |
|---|---|---|---|
| 4,651,940 | 3/1987 | Nakamura | 160/310 X |
| 4,952,855 | 8/1990 | Meins et al. | 318/467 |
| 4,953,608 | 9/1990 | Larsson | 160/1 |
| 5,164,896 | 11/1992 | Nagayasu | 318/467 X |
| 5,228,492 | 7/1993 | Jou | 160/133 X |

FOREIGN PATENT DOCUMENTS

| | | |
|---|---|---|
| 2656371 | 6/1991 | France . |
| 2657646 | 8/1991 | France . |
| 3425071 | 1/1986 | Germany . |
| 3806733 | 9/1989 | Germany . |
| 9109436 | 11/1991 | Germany . |

*Primary Examiner*—Blair M. Johnson
*Attorney, Agent, or Firm*—Greenblum & Bernstein P.L.C.

[57] ABSTRACT

The invention relates to a motor-driven roller blind comprising, on the one hand, an apron rolling up onto and unrolling from a winding shaft inside which is accommodated a tubular-type driving gear-motor and, on the other hand, means providing an electrical signal representative of the movement of the apron and an electrical-signal processing unit capable of acting on the running of the driving gear-motor, viz. to control the stopping of same in the event an obstacle is present. As a matter of fact, said means providing an electrical signal representative of the movement of the apron are comprised of at least one inductive sensor extending at least partly along the path followed by the apron, this inductive sensor being capable of creating an electromotive force under the action of the passing of a permanent magnet associated with the lower portion of the apron, which electromotive force is detected by the processing unit.

17 Claims, 1 Drawing Sheet

MOTOR-DRIVEN ROLLER BLIND

BACKGROUND OF THE INVENTION

1. Field of the Invention

The invention relates to a motor-driven roller blind comprising an apron formed by a juxtaposition of slats at least hingedly joined to each other and the ends of which move in side slides, this apron rolling up onto and unrolling from a winding shaft inside which is accommodated a tubular-type driving gear-motor. This roller blind may eventually also be provided with means providing an electrical signal representative of the movement of the apron and an electrical-signal processing unit capable of acting on the running of the driving gear-motor, viz. to control the stopping of same in the event an obstacle is present.

This invention will find its application in the field of the closing devices, such as roller blinds.

2. Description of the Prior Art

There is already known a roller blind corresponding to the above description. Thus, this motor-driven roller blind comprises an apron rolling up onto or unrolling from a winding shaft which is in this case rotatingly driven by tubular-type electric driving means, viz. a gear-motor, which is as a matter of fact accommodated inside the winding shaft. It should be noticed that this winding mechanism for the apron of the roller blind is generally arranged in a box under which extend slides serving for guiding the side ends of the slats the apron of comprised of, this during unrolling or rolling up of this latter.

This roller blind is also provided with means providing an electrical signal representative of the movement of the apron, these means being substantially comprised of a pulley onto which is wound a flexible member, such as a cord, the free end of which is connected to the end slat of the apron. Thus, during unrolling of this apron, this gives rise to the unwinding of the cord and the driving of said pulley. Associated with this latter are springy means ensuring the re-winding of the cord onto the pulley during the rolling up of the apron. There is also provided a signal generator mechanically connected to the spindle of the pulley and providing an electric voltage representative of the speed of rotation of the pulley. It is specified that this signal generator may preferably be in the shape of a Hall effect sensor, such as a synchronous motor used as a generator. According to another embodiment, there is also foreseen to use as signal generator a constraint gauge combined with a spring gradually tensioned by the rotation of the pulley.

In addition, there should be noticed the presence, at the level of this roller blind, of a logical processing unit capable of operating in learning mode and working mode, by sampling, and comprising means for storing, in learning mode, the value samples corresponding to the measured signal samples and means for comparing, in working mode, the stored value samples to value samples obtained in working mode. Thus, this logical unit comprises means for sampling the electric signal provided by the signal generator.

As a matter of fact, the main disadvantages experienced with a roller blind as described above are mainly due to the structure of the means providing an electrical signal representative of the movement of the apron. More particularly, such means are first of all bulky as far as they require the installation, at the level of the box of the roller blind, of a pulley onto which is capable of rolling up the transmission member formed by the cord. Furthermore, with that pulley should be associated the signal generator in the shape of a synchronous motor. As a matter o fact, this unit is positioned at the end of the winding shaft of the apron, which is not always feasible, due to lack of space.

In addition, the mechanical connection between the end slat of the apron and the pulley is a cause for operating trouble. Viz., the cord forming this transmission member can at any time get jammed through clamping either at the level of the roller blind itself or at the height of the door or window closed by this roller blind. Not taking into consideration that this cord is accessible to the user, which obviously increases the risks of incidents.

There is furthermore known a roller blind which uses, as means providing an electrical signal representative of the movement of the apron, first of all means for detecting the linear translation motion of the apron, in the shape of a roller rubbing against the surface of said apron and converting the linear displacement motion of the blind into a rotary motion. Furthermore, there are provided coding means, in the shape of a coding wheel provided with a number of peripheral and radial notches which is integral with said friction roller and driven by this latter. Associated with this coding wheel is a system for detecting the information provided by this latter, viz. an optoelectronic sensor, which is capable of detecting the passing of the notches of said coding wheel and providing an electrical signal. This latter is then processed at the level of a central processing unit.

There is also provided a roller blind apron sensor for detecting its arrival in the upper position. This sensor is carried out as a spring-pulled roller resting onto the surface of the apron and leaving this surface at the upper travel end in order to operate a microcontact controlling the stopping of the apron driving gear-motor.

It is foreseen to arrange such means providing an electrical signal representative of the movement of the apron at the upper end of a side slide or even at the supper end of each side slide a roller blind is provided with.

Although such means capable of providing an electrical signal representative of the movement of the apron are particularly bulky like those described first above, this is not their major disadvantage. They are indeed in no way adapted to roller blinds the apron of which is comprised of slats which are not only hingedly joined to each other, but also telescopic, so that the possibility exists of obtaining an openwork position as is the case in most domestic roller blinds. The roller rubbing against the surface of said apron is indeed necessarily arranged at the upper end of this latter. Hence, it can detect a change in the movement of this apron only when all the slats located under this roller have been piled up and tightened against each other.

In addition, in this case one also finds the mechanical connection which is indispensable between the means providing an electrical signal representative of the movement of the apron and this latter. Now, such a mechanical connection is liable to dysfunctions, viz. in the course of time, which cannot be accepted for a product, such as a roller blind, with a long lifetime.

SUMMARY OF THE INVENTION

The object of this invention is to cope with all the disadvantages experienced with the state of technique as described above, this by means of motor-driven roller blind of a simple design, while being particularly sure as regards both lifetime and safety itself.

To this end, the invention relates to a motor-driven roller blind comprising, on the one hand, an apron formed by a juxtaposition of slats at least hingedly joined to each other and the ends of which move in side slides, this apron rolling Lip onto and unrolling from a winding shaft inside which is accommodated a tubular-type driving gear-motor and, on the other hand, means providing an electrical signal representative of the movement of the apron and an electrical-signal processing unit capable of acting on the running of the driving gear-motor, viz. to control the stopping of same in the event an obstacle is present, said means providing an electrical signal representative of the movement of the apron being comprised of at least one inductive sensor extending at least partly along the path followed by the apron, this inductive sensor being capable of creating an electromotive force under the action of the passing of a permanent magnet associated with the lower portion of the apron.

The advantages achieved thanks to this invention mainly reside in that one can be free of any mechanical connection between the apron of the roller blind and any fixed member located at the level of this latter. In addition, the immobilizing of the apron by an obstacle can be noticed right from the jamming of the last slats the lower portion of this apron is comprised of.

In addition, the control of the movement of the apron is effected constantly and not discontinuously. This allows to more easily detect a change in the operation of the roller blind, e.g., due to the presence of an obstacle. This results into a less complex and, accordingly, less expensive processing unit. In this respect, this simplicity of design is to be found at the level of all these means capable of providing an electrical signal representative of the movement of the apron. It should viz. be noticed that they may advantageously form control means for stopping the running of the gear-motor at the upper and lower travel end of the apron. More particularly, it can be foreseen that the permanent magnet, when arriving at the upper or lower travel end, withdraws in the presence of the inductive sensor, at the upper or lower end of this latter, causing the gear-motor to stop.

Moreover, it should be noticed that the very adjunction of a permanent magnet, viz. to one of the slats the lower portion of this apron is comprised of, allows to contemplate even in another way an easy control of this stopping the running of the driving gear-motor. Viz., such a permanent magnet may advantageously form the remote control means for a switch placed at the lower portion and at the upper portion of a slide, such as a flexible leaf switch (FLS) or an inductive sensor. Thus, when unrolling the apron, the passing of the permanent magnet associated with this latter in front of a flexible leaf switch or such inductive sensor located at the lower portion of the slide causes, either immediately or in a delayed manner, the stopping of the driving gear-motor. This also applies to the rolling up and when the permanent magnet passes in front of the switch located at the upper end of the slide.

In this respect, the invention also relates to a motor-driven roller blind comprising, on the one hand, an apron formed by a juxtaposition of slats at least hingedly joined to each other and the ends of which move in side slides, this apron rolling up onto and unrolling from a winding shaft inside which is accommodated a tubular-type driving gear-motor, one slat forming the lower portion of the apron being provided with remote control means, such as a permanent magnet, flexible leaf switch (FLS)-type switches or inductive sensors capable of controlling, either directly or through a suitable processing unit, the stopping of the running of the driving gear-motor when the apron arrives at the lower travel end and at the upper travel end.

BRIEF DESCRIPTION OF THE DRAWINGS

The invention will be better understood when reading the thorough description which follows with reference to the drawings related to one embodiment.

DESCRIPTION OF THE PREFERRED EMBODIMENT

Figure 1:
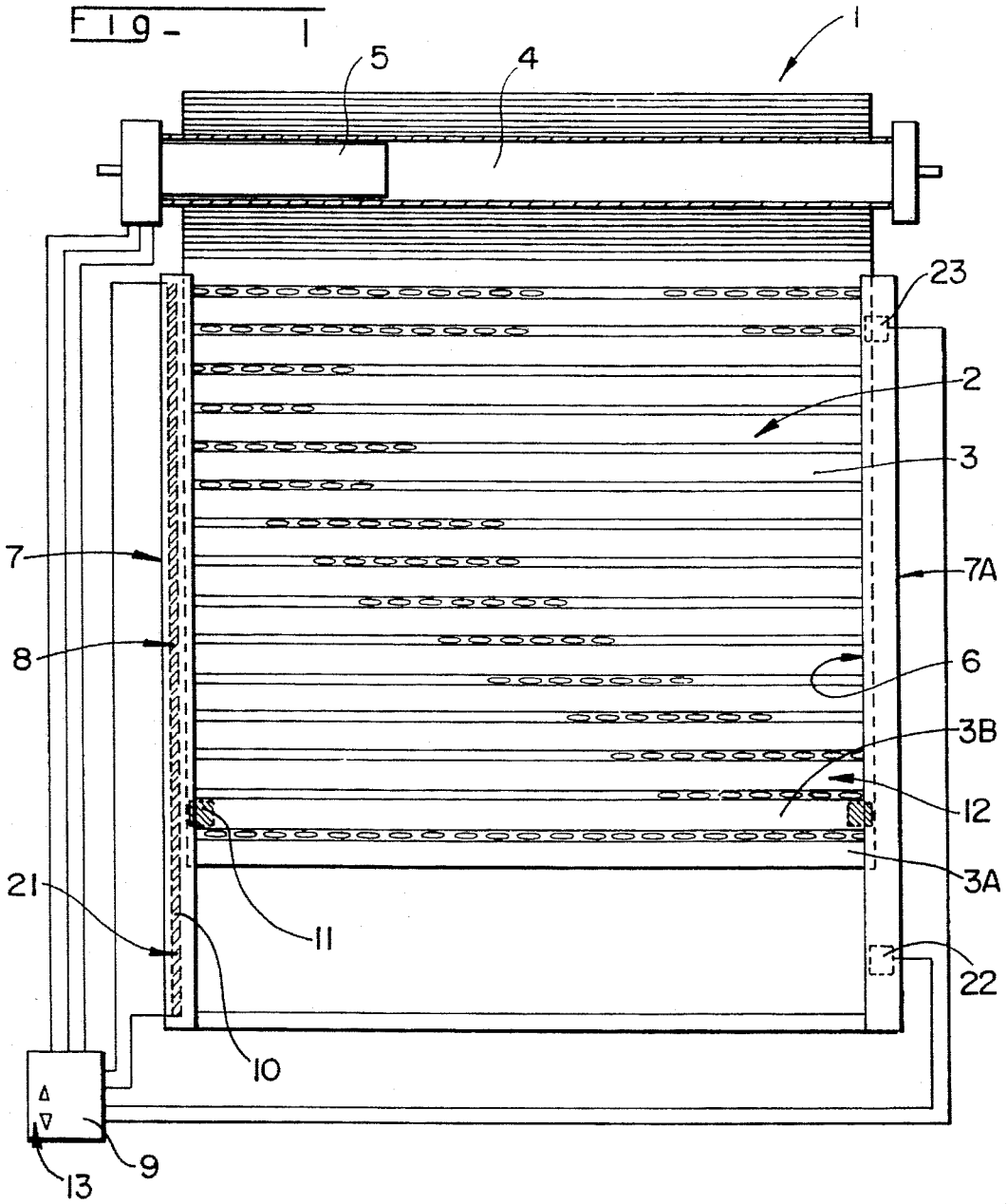
FIG. 1 shows a schematical elevational view of a roller blind according to the invention.
Figure 2:
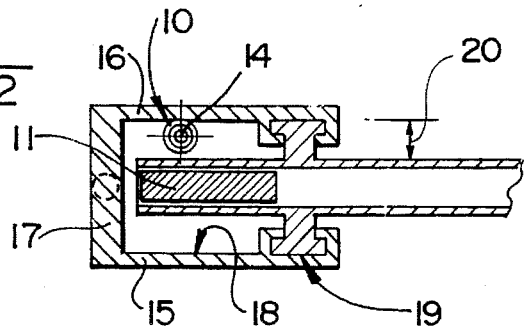
FIG. 2 shows a schematical cross-sectional view of a slide.

As appears in the Figures of the attached drawing, this invention relates to a motor-driven roller blind 1; this latter includes an apron 2 formed by a juxtaposition of slats 3, at least hingedly joined to each other. As a matter of fact, these slats 3 are very often also telescopic with respect to each other, so that the apron can adopt an openwork position which just corresponds to keeping these slats 3 separated from each other.

This apron 2 rolls up onto or unrolls from a winding shaft 4 generally rotatingly mounted into a box topping the opening provided in a building construction which has to be closed by means of this motor-driven roller blind 1. Inside this winding shaft 4 is accommodated a tubular-type driving gear-motor 5.

It should be noticed that when controlling the rolling up or the unrolling of the apron 2, the ends 6 of the slats 3 move in side slides 7. These latter are usually positioned at the level of the vertical sides of a door or window recess or even on the outer face of the stiles of the sash-frame of a door, French window or the like.

This motor-driven roller blind 1 is in addition provided with means 8 capable of providing an electrical signal representative of the movement of the apron 2 as well as with a unit 9 for processing this electrical signal capable of acting on the running of the driving gear-motor 5, e.g. to control the stopping of this latter in the event an obstacle is present on the path of the apron 2.

There should indeed be avoided that such an obstacle placed on the path of the apron 2 of the motor-driven roller blind 1 leads to an incident at the level of the operation of this motor-driven roller blind 1 or to any accident whatsoever. Thus, according to the invention, these means 8 which are capable of providing an electrical signal representative of the movement of the apron 2 are comprised of at least one inductive sensor 10 extending at least partly along the path followed by the apron 2, viz. along a side slide 7, so that it be capable of creating an electromotive force under the action of the passing in front of this inductive sensor 10 of a permanent magnet 11 associated with the lower portion 12 of the apron 2. This electromotive force produced by the inductive sensor 10 is of course inexistent in the absence of any motion of the permanent magnet 11 and, accordingly, of the apron 2. Furthermore, it is positive within the framework of the movement of the apron in one direction and negative when this apron 2 moves in the opposite direction.

Thus, through the processing unit 9, there is proceeded to the control and the checking of the existence of an electromotive force produced by the inductive sensor 10. More particularly, this processing unit 9 ensures the stopping of the running of the driving gear-motor 5 as soon as it detects the passing of a current through this driving gear-motor 5 and the absence of voltage at the terminals of the inductive sensor 10. In addition, this processing unit 9 may have as a function to stop the running of the driving gear-motor 5 if during the unrolling of the apron 2 there is detected a reversal of the electromotive force and, accordingly, of the voltage at the terminals of the inductive sensor 10 without this reversal being due to a control of reversal of the motion of the apron 2 through a voluntary action of the user onto actuation means 13 such a motor-driven roller blind 1 is systematically fitted with.

According to a preferred embodiment of the invention, the inductive sensor 10 is in the shape of an inductance coil the terminals of which are connected to the processing unit 9 and which is wound onto a magnetic support 14, more particularly an hollow metal tube with a small cross-section. This cross-section of the magnetic support 14 is advantageously reduced to such an extent that this inductive sensor 10 can be positioned inside a slide 7 while authorizing the moving inside this latter of the ends 6 of the slats 3 the apron 2 is comprised of. In this respect, it should be noticed that a slide 7 is in the shape of profile with a U-shaped cross-section comprising an outer wall 15, an inner wall 16 and a bottom 17. Very often, the outer 15 and inner 16 walls include, on their sides 18 facing each other, sealing brushes 19 having a thickness 20 determining the maximum cross-section the inductive sensor 10 may adopt.

According to another embodiment, this inductive sensor 10 is installed on the bottom 17 of the slide 7.

The advantages resulting from such an arrangement of the inductive sensor 10 inside a slide 7 reside in that said sensor is perfectly protected against voluntary or involuntary external aggressions. Thus, it is viz. difficultly accessible by a user.

As regards the permanent magnet 11, of the type made of anisotropic ferrite, it is installed inside and at the end 6, in front of an inductive sensor 10, of a slat 3 the lower portion 12 of the apron 2 is comprised of. As a matter of fact, it is advantageous to install this permanent magnet 11 in the last slat 3A or the last but one slat 3B of the apron 2.

Furthermore, there is advantageously foreseen to fit the inductance coil, at its lower portion 21, with a larger number of windings with a view to obtaining an electrical signal of a greater amplitude, in order to control the arrival at the lower travel end of the apron 2 and to allow a complete closing of the motor-driven roller blind 1.

It is of course possible to install such an inductive sensor 10 in each of the slides 7 of the motor-driven roller blind 1, this in order to more rapidly detect the presence of an obstacle located on the path of the apron 2, while being sidely offset with respect to the vertical median plane of same, so that there is a phase shift between the jamming of one end of the slats 3 and the other end.

It should be noticed that such means 8 capable of providing an electrical signal representative of the movement of the apron 2 according to the invention in addition allow a simplification of the control of the running of the driving gear-motor 5, viz. for controlling the stopping of same either when the apron 2, when unrolled, arrives at the lower travel end or, when rolled up, arrives at the upper travel end. Viz., the length of the inductive sensor 10 may be determined so that when it is no longer under the action of the permanent magnet 11 the processing unit 9 detects an absence of electromotive force and, accordingly, the arrival at the upper position and/or the lower position of the apron 2. Then the stopping of the driving gear-motor 5 is controlled, this either immediately or in a delayed way.

As a matter of fact, this control of the running of the driving gear-motor 5 is simply made easier through the mere presence of the permanent magnet 11 at the level of the lower portion 12 of the apron 2. Such a permanent magnet 11 can indeed advantageously form the remote control means for switches 22, 23 of the flexible leaf switch (FLS) type or Reed bulbs to cause the stopping of the running of the driving gear-motor 5 when the apron 2 is unrolled and at the lower travel end or rolled up and at the upper travel end. More particularly, such switches 22, 23 are, in these circumstances, installed either on a slide 7 or inside this latter, so that the running of the driving gear-motor 5 is stopped at the passing of the permanent magnet 11 e.g. the end 6 of one slat 3A, 3B is provided with. According to another embodiment, the switches 22, 23 capable of being controlled through the permanent magnet 11 placed on the apron 2 may be formed by inductive sensors connected to the processing unit 9. Thus, as soon as this latter detects an electrical signal of a given, positive or negative, intensity and sign at the terminals of one of these inductive sensors, it controls the stopping of the running of the driving gear-motor 5, since this corresponds to the arrival of the apron at the lower travel end or at the upper travel end. In order to better understand the invention through clearer drawings, the flexible leaf switch-type switches 22, 23 or inductive sensors have been shown, in FIG. 1, in the slide opposite the one accommodating the inductive sensor 10. They may however be associated with the same slide 7 as this latter, viz. in order to avoid the installing of a second permanent magnet in a slat of the apron 2.

Of course, like for the inductive sensors at the terminals of which there not only must be detected an electrical signal, but the positive or negative sign of this latter has also to be taken into consideration in the case of flexible leaf switches or Reed bulbs, only one of them is active according to the direction of rotation imparted to the winding shaft 4. Thus, only the Reed bulb 22 arranged at the bottom of the slide 7 is capable of stopping the driving gear-motor 5 when controlling the unrolling of the apron 2. On the contrary, only the Reed bulb 23 arranged at the top of the slide 7 can control the stopping of the running of the driving gear-motor 5 when the apron arrives in the upper position, rolled up about the winding shaft 4.

It should be noticed that these switches 22, 23 thus controlled by a permanent magnet 11, irrespective of their technology, allow a precision at the level of the travel ends which hitherto was controlled by a system of storing, and thus deriving, without taking into consideration the actual situation, i.e. the actual position of the apron when controlling these travel ends.

When reading the description above, one understands very well that this invention not only provides actual solutions to the problems experienced in this field over the past, but, in addition, allows to simplify the design of the motor-driven roller blinds. In particular, the means intended for providing an electrical signal representative of the movement of the apron are easy to make and of a negligible size. They are however particularly reliable, since they are insensitive to aggressions from outside.

In addition, the association of a permanent magnet with the apron allows a particularly simplified control of the running of the driving gear-motor which, accordingly, proves less complex.

I claim:

1. A motor-driven roller blind comprising:

an apron formed by a juxtaposition of slats at least hingedly joined to each other and including ends moving in side slides;

a winding shaft around which said apron rolls up and unrolls from;

a tubular-type driving gear-motor accommodated inside said winding shaft;

means for providing an electrical signal representative of the movement of said apron;

an electrical-signal processing unit capable of stopping the running of said driving gear-motor in the event that an obstacle is present, wherein said means for providing an electrical signal comprises at least one inductive sensor extending at least partly along a path followed by said apron, and wherein said apron includes a lower portion provided with a permanent magnet capable of creating an electromotive force when passing said inductive sensor.

2. A motor-driven roller blind according to claim 1, wherein said processing unit controls the stopping of the running of said driving gear-motor as soon as said processing unit detects the passing of a current through said driving gear-motor and the absence of voltage at terminals of said inductive sensor.

3. A motor-driven roller blind according to claim 1, wherein said processing unit controls the stopping of the running of said driving gear-motor upon detecting a reversal of the electromotive force, during the unrolling of said apron, and thus a reversal of the voltage at the terminals of said inductive sensor which is not due to a voluntary control of reversal of the motion of said apron by a user.

4. A motor-driven roller blind according to claim 1, wherein said inductive sensor comprises an inductance coil having terminals connected to said processing unit, and said inductance coil is wound onto a magnetic support.

5. A motor-driven roller blind according to claim 4, wherein said magnetic support comprises a cross-section small enough to allow said inductive sensor to be positioned inside one of said side slides while still permitting movement of said ends of said slats along said side slides.

6. A motor-driven roller blind according to claim 1, wherein said inductive sensor is installed near a bottom end of said side slats.

7. A motor-driven roller blind according to claim 1, wherein said permanent magnet comprises anisotropic ferrite, and said permanent magnet is installed inside and at an end of one of said slats at a lower portion of said apron, in front of said inductive sensor.

8. A motor-driven roller blind according to claim 1, wherein said inductive sensor comprises an inductance coil including a lower portion having a larger number of windings for amplification of an electrical signal to control the arrival of said apron at the lower travel end.

9. A motor-driven roller blind according to claim 1, wherein said means for providing an electrical signal controls the stopping of the driving of said gear-motor when said apron arrives at a lower travel end.

10. A motor-driven roller blind according to claim 1, wherein said inductive sensor has a length determined so that when said apron is at an upper travel end, said inductive sensor no longer senses said permanent magnet, leading to an absence of electromotive force detected by said processing unit and stopping of the running of said driving gear-motor.

11. A motor-driven roller blind according to claim 1, comprising flexible leaf type switches actuated by the passing of said permanent magnet in order to control, directly or through the processing unit, the stopping of the running of said driving gear-motor when said apron arrives at the lower travel end and at the upper travel end.

12. A motor-driven roller blind according to claim 4, wherein said magnetic support comprises a hollow metal tube.

13. A motor-driven roller blind according to claim 7, wherein said permanent magnet is installed inside the bottom most of said slats.

14. A motor-driven roller blind according to claim 7, wherein said permanent magnet is installed inside the second to the bottom most of said slats.

15. A motor-driven roller blind according to claim 1, wherein said means for providing an electrical signal controls the stopping of the driving of said gear-motor when said apron arrives at an upper travel end.

16. A motor-driven roller blind according to claim 1, wherein said inductive sensor has a length determined so that when said apron is at a lower travel end, said inductive sensor no longer senses said permanent magnet, leading to an absence of electromotive force detected by said processing unit and stopping of the running of said driving gear-motor.

17. A motor-driven roller blind according to claim 1, comprising inductive sensors actuated by the passing of said permanent magnet in order to control, directly or through the processing unit, the stopping of the running of said driving gear-motor when said apron arrives at the lower travel end and at the upper travel end.

* * * * *